US006860770B2

(12) United States Patent
Hassan et al.

(10) Patent No.: US 6,860,770 B2
(45) Date of Patent: Mar. 1, 2005

(54) METHOD AND DEVICE FOR LOW-NOISE UNDERWATER PROPULSION AND FOR REDUCING HULL DRAG

(75) Inventors: Ahmed A. Hassan, Mesa, AZ (US); David B. Domzalski, Gilbert, AZ (US)

(73) Assignee: The Boeing Company, Chicago, IL (US)

( * ) Notice: Subject to any disclaimer, the term of this patent is extended or adjusted under 35 U.S.C. 154(b) by 0 days.

(21) Appl. No.: 10/631,125

(22) Filed: Jul. 31, 2003

(65) Prior Publication Data

US 2004/0121664 A1 Jun. 24, 2004

Related U.S. Application Data

(63) Continuation-in-part of application No. 10/323,105, filed on Dec. 18, 2002.

(51) Int. Cl.[7] ..... B63H 11/00
(52) U.S. Cl. ..... 440/38; 114/315; 114/289
(58) Field of Search ..... 114/67 R, 67 A, 114/289, 315; 440/38

(56) References Cited

U.S. PATENT DOCUMENTS 608,757 A * 8/1898 Culbertson ..... 440/44
640,946 A * 1/1900 Quanonne ..... 114/67 A
3,435,796 A * 4/1969 Merrill ..... 114/67 R
3,556,039 A * 1/1971 Sfredda ..... 440/17
5,787,829 A * 8/1998 Oshima ..... 114/67 A
5,813,625 A 9/1998 Hassan et al.
5,938,404 A 8/1999 Domzalski et al.
6,092,990 A 7/2000 Hassan et al.
6,234,751 B1 5/2001 Hassan et al.
6,471,477 B2 10/2002 Hassan et al.
6,543,719 B1 4/2003 Hassan et al.

* cited by examiner

*Primary Examiner*—Jesus D. Sotelo
(74) *Attorney, Agent, or Firm*—Thompson Coburn LLP

(57) ABSTRACT

A method and apparatus is disclosed for producing propulsion underwater with minimal acoustical emission. In basic concept, the method comprises the expulsion and sucking of liquid into and out of a liquid port of a watercraft in a manner generating compression and expansion waves adjacent the liquid port. Such expansion and compression waves generate a positive net thrust on the watercraft in a direction opposite that of their expulsion. Also disclosed is a method and apparatus for reducing the drag caused by hull skin friction by actively increasing the momentum of the liquid stream boundary layer adjacent a watercraft via the expulsion of fluid (liquid or gas) from ports in the hull of such a watercraft.

19 Claims, 6 Drawing Sheets

METHOD AND DEVICE FOR LOW-NOISE UNDERWATER PROPULSION AND FOR REDUCING HULL DRAG

This application is a continuation-in-part of copending U.S. application Ser. No. 10/323,105, filed Dec. 18, 2002.

BACKGROUND OF THE INVENTION

Various types of propulsion devices are known for propelling watercraft through water environments. Such types of propulsive devices include types that push water, push air, and that are propelled by other means, such as by rocket. This invention pertains particularly to water pushing propulsion devices.

Various types of water pushing devices have clearly been proven successful and have been utilized for decades and even centuries. Presently, the most common of such devices in use are the exposed rotating propeller and the ducted rotating propeller (the later often being referred to as "jet" propulsion). In most circumstances, the exposed type of propeller is the most efficient and practical means for powering a watercraft. However, in some situations, such as in situations involving a watercraft such as a Jet Ski® or a Wave Runner®, an exposed propeller would present significant risk of personal injury, and therefore a ducted propeller is utilized in place thereof. Although generally less efficient, ducted propellers present significantly less risk of personal injury.

In other situations, such as in military applications in particular, it is desirable to minimize the noise or acoustic signature being emitted from the propulsive device of the watercraft. This is particularly the case with military submersibles, such as manned and unmanned submarines, since acoustic emissions are often the primary way such watercraft are detected. However, watercraft such as fishing boats could also benefit from propulsive devices having reduced acoustic emissions, due to the impact of such emissions on fish. Nonetheless, due to the rotational nature of both exposed propellers and ducted propellers, such propulsion devices inherently produce appreciable acoustic emissions. Furthermore, the turbulence produced by either type of propeller propulsion also produces detectable acoustic emissions. This is the case regardless of whether cavitation occurs, albeit cavitation substantially increases the acoustic emissions. Thus, an alternative means of propelling watercraft, and in particular submersible watercraft, in a manner producing substantially less acoustic emission is desired.

It is also known that the friction between the hull of a watercraft causes a reduction in the momentum of the liquid stream passing adjacent the hull, which results in drag. The region in which reduction in momentum occurs defines a boundary layer of the liquid stream and, in general, decreasing the boundary layer thickness results in a decrease in drag. To this end, numerous products such as special waxes and other techniques have been utilized in an effort to reduce the skin friction of watercraft hulls. While such products and techniques have proven to be successful, other solutions to reducing drag remain desirable.

SUMMARY OF THE INVENTION

The present invention achieves an entirely new method and apparatus for producing propulsion underwater. This method and apparatus is capable of producing propulsion without rotating parts and without significant noise emissions. Furthermore, the invention in its preferred embodiment is capable of propelling a watercraft without opening and closing valves, without using articulating bearings or bushings, without producing significant turbulence, and without any other means that produces an appreciable acoustic emission signature.

Building on the principles of the methods and apparatus of the invention for producing propulsion, also disclosed herein are methods and apparatus for achieving drag reduction via active flow means. Such active flow means decrease the reduction of momentum within the liquid stream boundary layer passing adjacent the hull of a watercraft, and thereby reduce the drag associated therewith. Moreover, these methods and apparatus for reducing drag have similarities with the above-mentioned methods and apparatus for propulsion and can be utilized in combination therewith.

In general, a first method of practicing the invention comprises the steps of providing a watercraft having a liquid chamber and at least one liquid port. The liquid port allows communication of liquid between the liquid chamber and the liquid environment in which the watercraft is traveling through. This method also comprises the step of repetitively increasing and decreasing the internal volume of the liquid chamber in a manner such that liquid is expelled from the liquid port into the liquid environment and the step of propelling the watercraft within the liquid environment via such expulsion of liquid from the liquid port.

A second method of practicing the invention generally comprises the step of providing a watercraft having a main body and a reciprocating member, and providing a water environment external to the watercraft. The water environment is in liquid communication with the reciprocating member of the watercraft. The method further comprises propelling the watercraft through the water via alternating compression and expansion waves created by moving the reciprocating member in a linearly reciprocating manner relative to the main body of the watercraft.

A third method of practicing the invention generally comprises providing a watercraft having one or more liquid chambers and at least one liquid port. The liquid port allows communication of liquid between the liquid chamber and a liquid environment external to the watercraft. The method also comprises expelling liquid from the liquid port into the liquid environment in a manner generating a first thrust on the watercraft in a direction opposite that of the expelled liquid. Yet further, the method comprises sucking liquid into the liquid port from the liquid environment in a manner generating a second thrust on the watercraft in a direction equal to that of the expelled liquid. The second thrust is less than the first thrust in magnitude. Finally, the method further comprises propelling the watercraft within the liquid environment by repetitively performing and alternating the steps of the expelling and the sucking of liquid.

A fourth method of practicing the invention comprises the step of providing a watercraft that comprises a hull, a fluid chamber, and at least one fluid port. The fluid port allows fluid communication between the fluid chamber and a liquid environment external to the watercraft. The method further comprises the step of propelling the watercraft within the liquid environment in a manner such that a liquid stream boundary layer exist adjacent the hull of the watercraft. Yet further, the method comprises the step of repetitively increasing and decreasing the internal volume of the fluid chamber in a manner such that fluid is expelled from the fluid port into the liquid stream boundary layer.

A fifth method of practicing the invention comprises the step of providing a watercraft that comprises a hull and a reciprocating member. The method also comprises the step of providing a liquid environment that is external to the watercraft and that is in liquid communication with the reciprocating member. The method further comprises the step of propelling the watercraft within the liquid environment in a manner such that a liquid stream boundary layer exist adjacent the hull of the watercraft. Yet further, the method comprises the step of increasing momentum within the liquid stream boundary layer by moving the reciprocating member in a linearly reciprocating manner relative to the hull of the watercraft.

A first apparatus in accordance with the invention comprises a main body, a liquid chamber, a reciprocating member, and a liquid passageway. The liquid chamber contains liquid and the reciprocating member is in communication with the liquid within the liquid chamber. The reciprocating member is also operatively connected to the main body in a manner such that the reciprocating member is linearly movable between first and second positions in a reciprocating manner. The liquid passageway creates a liquid connection between the liquid in the liquid chamber and an environment external to the main body.

A second apparatus in accordance with the invention comprises a watercraft having a hull, a reciprocating member, a fluid passageway, and an opening. The reciprocating member is operatively connected to the hull in a manner such that the reciprocating member is linearly movable between first and second positions in a reciprocating manner. The fluid passageway is partially bound by the reciprocating member and the opening extends through an exterior surface of the hull and forms a portion of the fluid passageway.

It should be appreciated that the above mentioned methods and apparatus are not all inclusive of the methods and apparatus for practicing the invention. This being said, while the principal advantages and features of the invention have been described above, a more complete and thorough understanding of the invention may be obtained by referring to the drawings and the detailed description of the preferred embodiment, which follow.

Figure 1:
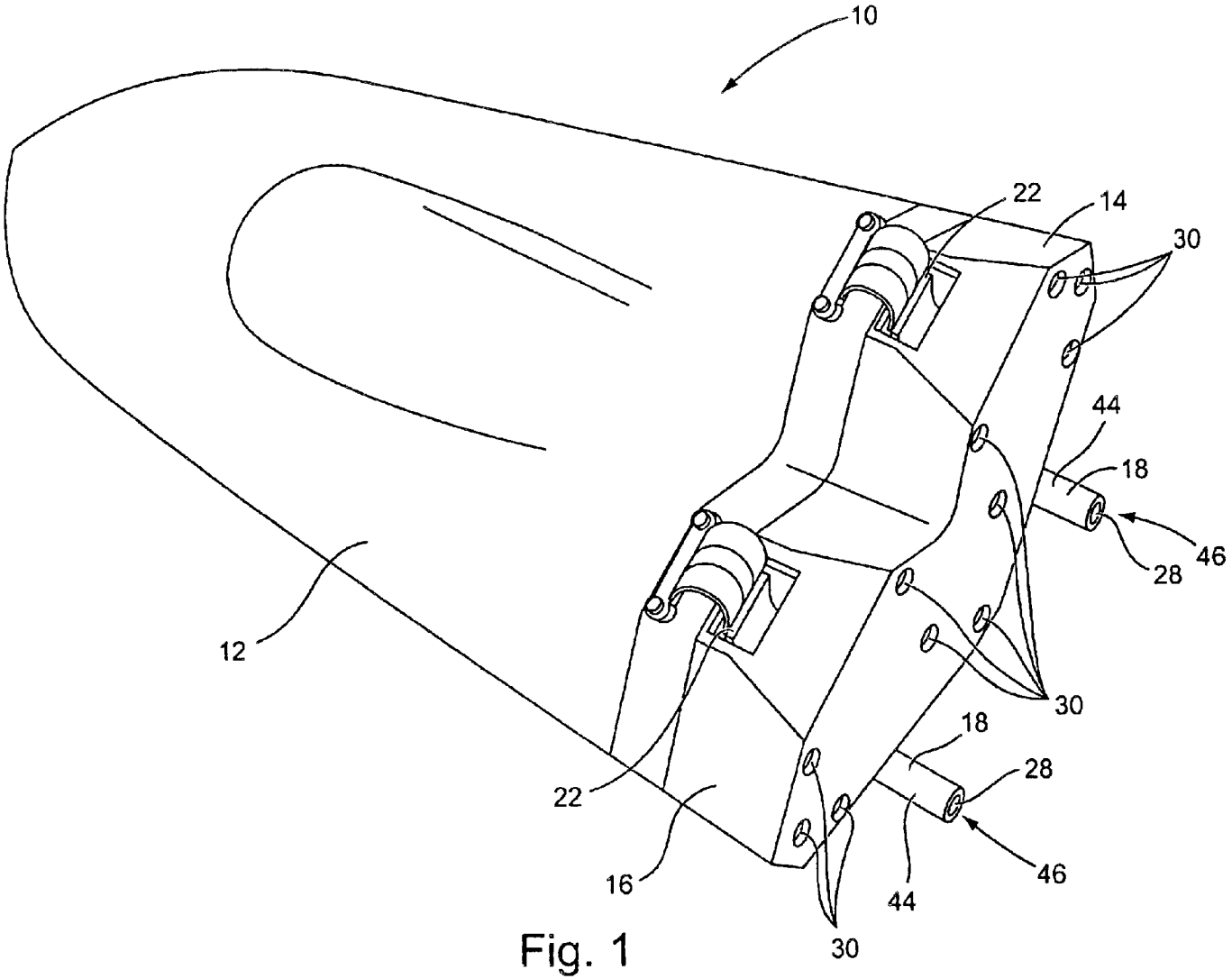
FIG. 1 is perspective view of the watercraft of the preferred embodiment showing the top, rear, and side thereof.

Reference characters in the written specification indicate corresponding items shown throughout the drawing figures.

DETAILED DESCRIPTION OF THE PREFERRED EMBODIMENT OF THE INVENTION

Figure 2:
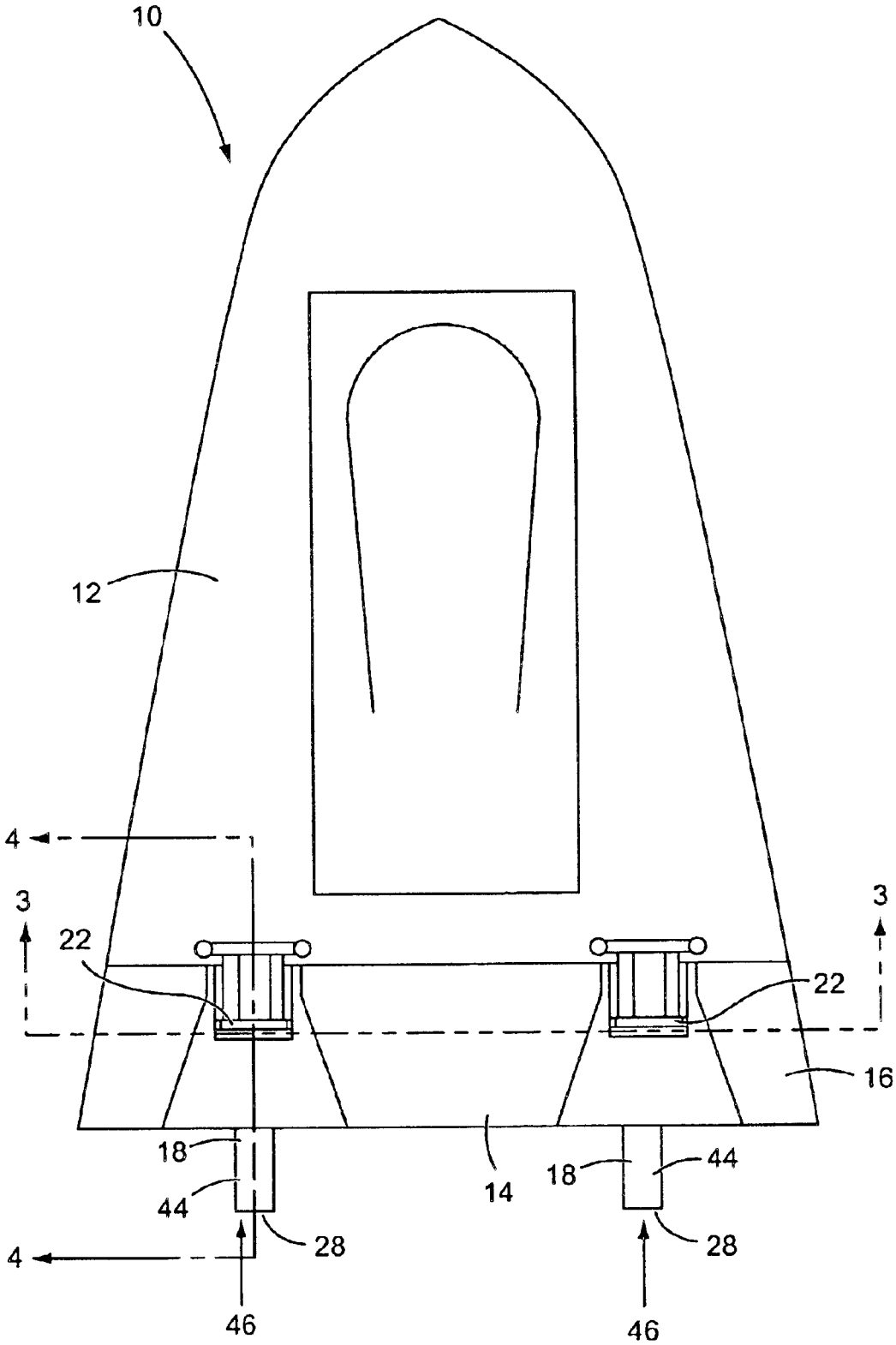
FIG. 2 is a top plan view of the watercraft shown in FIG. 1.
Figure 3:
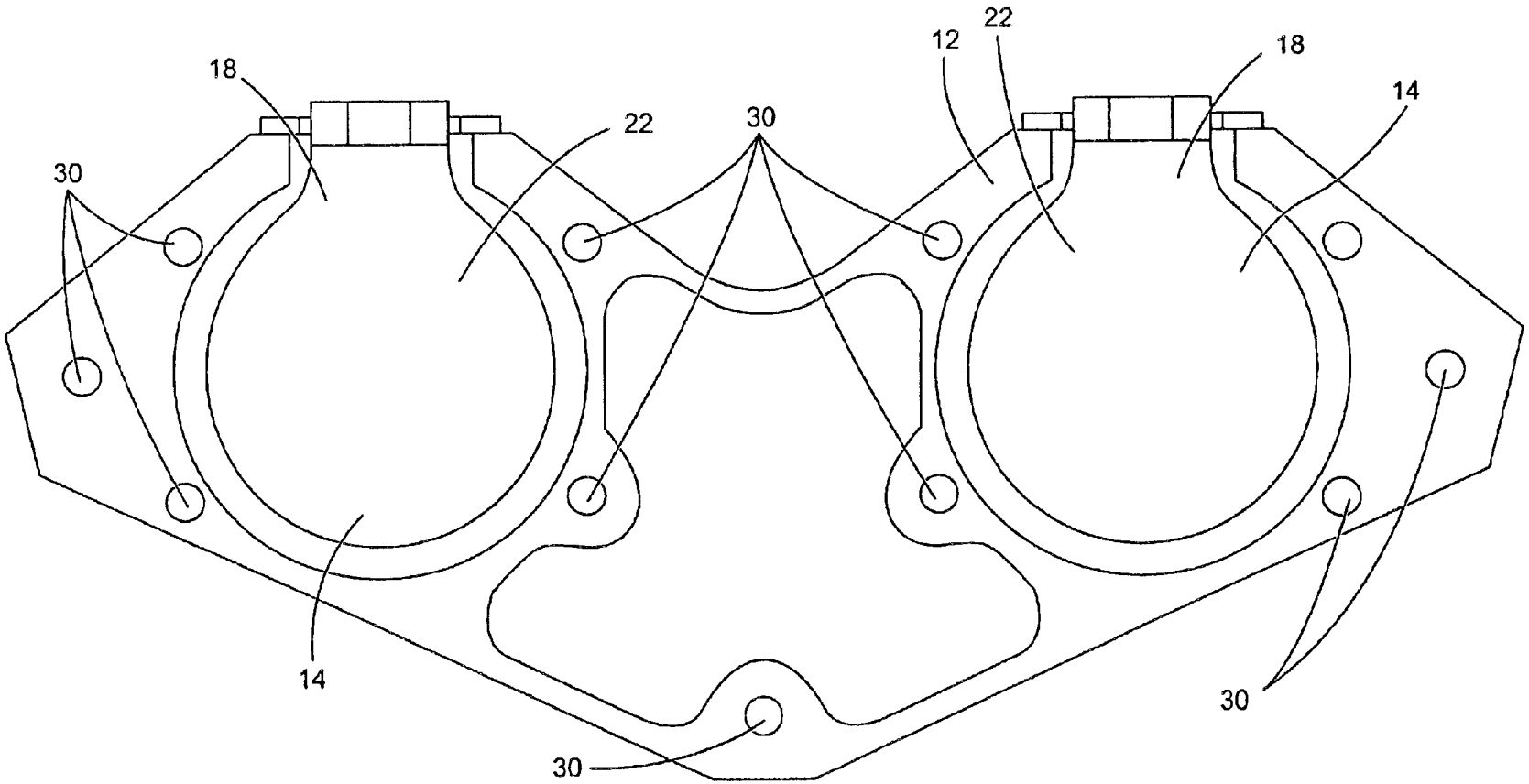
FIG. 3 is a cross-sectional view of the watercraft shown in FIG. 1, looking forward and taken about the line 3—3 of FIG. 2.

In accordance with the invention, a watercraft has been successfully produced and tested. The watercraft 10 is shown in its entirety in FIGS. 1 and 2 and is configured to float on the surface of a water environment. However, it should be appreciated that the invention could be equally utilized in conjunction with submersible watercraft without undue experimentation or modifications.

In general, the watercraft 10 comprises a main body 12 and an aft propulsion assembly 14. The main body 12 is formed of a composite glass fiber material, but could also be formed of plastic, metal, or other materials suitable for forming watercraft. The main body 12 is also aerodynamically shaped to reduce its drag as it travels through a water or other liquid environment.

The propulsion assembly 14 comprises a housing member 16 and two propulsion generating sub-assemblies 18. The propulsion generating sub-assemblies 18 are preferably identical to each other and each preferably comprises an electromagnetic actuator 20, a reciprocating member 22, a liquid chamber 24, a sealing member 26, and a liquid port 28. The housing member 16 and the main body 12, together with each other, surround most portions of the propulsion generating sub-assemblies 18 and are releasably connected to each other via a plurality of screws or bolts (not shown) inserted into attachment holes 30. The housing member 16 is preferably formed of the same material as the main body 12 and is preferably contoured such that it mates flush with the main body. Because the propulsion generating sub-assemblies 18 are identical to each other, only one of such assemblies is described herein. However, it should be appreciated that the following description of the various components of one of the propulsion generating sub-assemblies 18 applies equally to both such assemblies.

Figure 4:
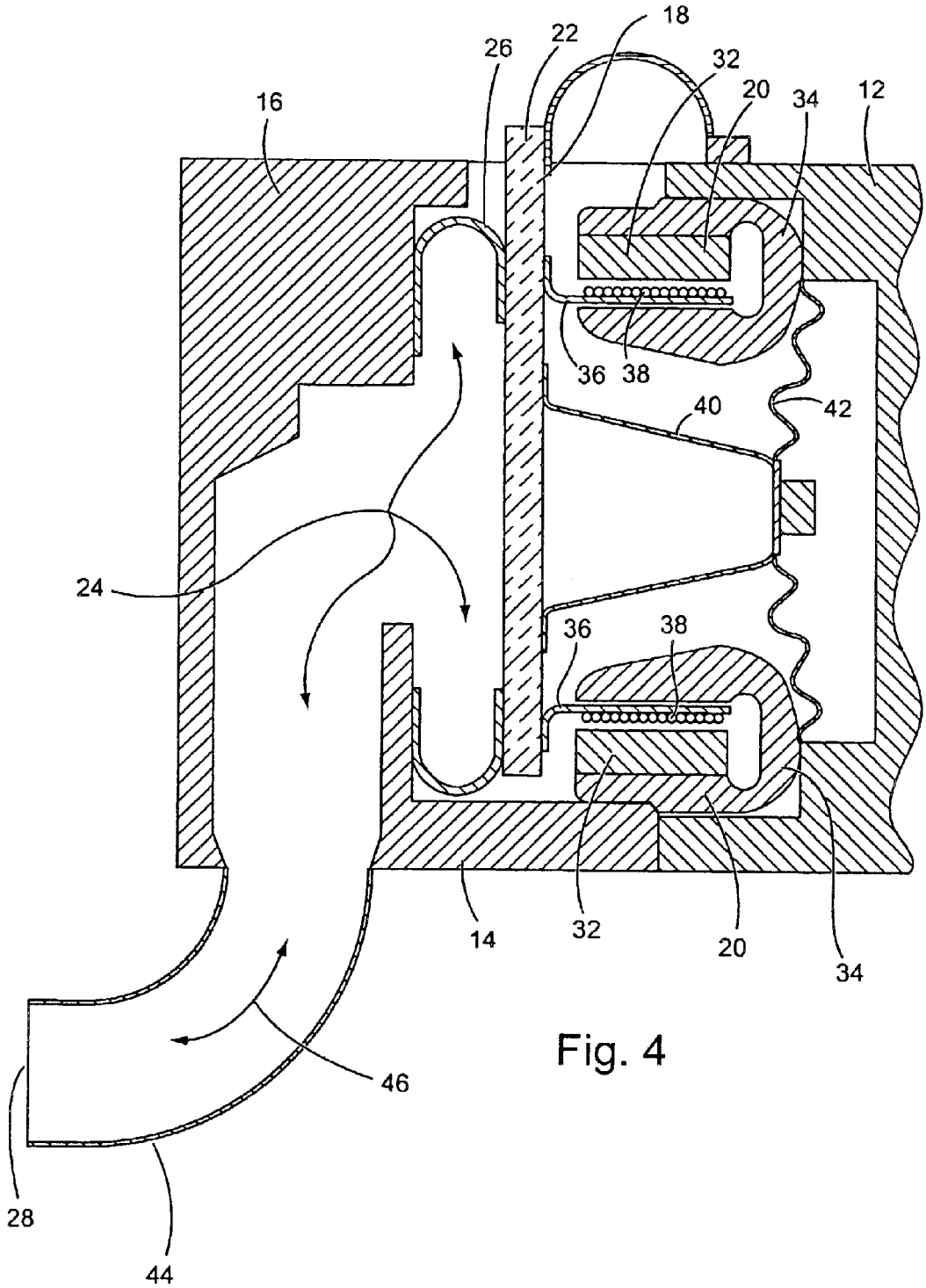
FIG. 4 is a partial cross-sectional view of the watercraft shown in FIG. 1, looking sideways and taken about the line 4—4 of FIG. 2.

The electromagnetic actuator 20 is preferably a voice coil actuator of the type well known for use in connection with acoustical loudspeakers. As is typical of such voice coils, the electromagnetic actuator 20 comprises an annular permanent magnet 32, an annular steel armature 34, and an annular driving bracket 36. An electrically conductive wire coil 38 encircles the driving bracket 36 and is electrically connected to an electrical power source and a voltage and/or frequency modulator (not shown) provided within the main body 12 of the watercraft 10. The wire coil 38 of the driving bracket 36 is positioned within the annular gap between the permanent magnet 32 and the armature 34 in a manner such that alternating current passing through the wire coil will cause the driving bracket to forcibly oscillate, horizontally as shown in FIG. 4. The driving bracket 36 is also connected to the reciprocating member 22 in a manner such that the reciprocating member oscillates therewith. The reciprocating member 22 is preferably a lightweight rigid structure preferably having a carbon fiber, honeycomb construction. A frustoconical composite former 40 and an annular flexure 42, which comprise portions of the electromagnetic actuator 20, act to maintain the proper orientation of the reciprocating member 22 and driving bracket 36 assembly as it oscillates.

The liquid chamber 24 is a cavity that is bound partially by the housing member 16 and partially by the reciprocating member 22. The annular sealing member 26 also partially bounds the liquid chamber 24 and flexibly connects the reciprocating member to the housing member 16. The sealing member 26 is preferably a bellows made of silicone-impregnated fiberglass.

The liquid port 28 is preferably an opening at the end of a nozzle 44 having an interior passageway 46 that provides a liquid connection between the liquid chamber 24 and the liquid environment adjacent the watercraft 10. The nozzle 44 preferable extends downward from beneath housing member 16 to ensure that the liquid port 28 remains underwater. Additionally, the nozzle 44 turns aft and extends axially rearward before terminating at the liquid port 28.

As the reciprocating member 22 oscillates in response to the alternating current supplied to the wire coil 38, it should be appreciated that the movement of the reciprocating member causes the internal volume of the liquid chamber 24 to repetitively increase and decrease. In use, the liquid chamber 24 is preferably completely filled with liquid and the sealing member 26 prevents such liquid from escaping out of the liquid chamber between the reciprocating member 22 and the housing member 16. Thus, the oscillation of the reciprocating member 22 causes the liquid to be forced into and out of the liquid chamber and the liquid port 28 through the passageway of the nozzle 44.

As liquid is expelled from the liquid port 28, the watercraft 10 experiences a reaction force that causes a forward thrust on the watercraft. However, when liquid is drawn in through the liquid port 28, an equal and opposite thrust is not experienced. This is because the liquid is alternatively expelled from and sucked into the liquid port 28 at rapid intervals, thereby creating expansion and compression waves. When liquid is being expelled from the liquid port 28, it has substantial momentum in the direction in which it was expelled, which is axially aft due to the configuration of the terminal portion of the nozzle 44. Conversely, when liquid is being drawn into the liquid port 28, it is drawn in both axially and radially inward from multiple directions. Thus, the opposite radial components of momentum of liquid being drawn into the liquid port negate each other, and the remaining axial component is insufficient to negate the axial momentum of the previously expelled wave of liquid. Hence, based on the law of conservation of momentum and the other well-known principles of physics, the net result of any given cycle of oscillation of the reciprocating member 22 is a forward thrust on the watercraft.

It should be appreciated that the watercraft 10 is fairly small. For example, the reciprocating member 22 is approximately 1.5 inches in general diameter, the liquid ports are only 0.25 inches in diameter, and the stroke of oscillation is less than 0.1 inches. This being said, for this watercraft 10, it has been found that oscillations of the reciprocating member 22 of between twenty and thirty hertz produce a sufficient forward thrust to propel the watercraft in its liquid environment. However, it should also be appreciated that both the stroke and the frequency of the oscillation of the reciprocating member 22 affect the thrust that is generated. Obviously, in the above-described configuration, the frequency of the oscillations of the reciprocating member 22 will be equal to the frequency of the electrical current supplied to the electromagnetic actuator 20. The stroke, on the other hand, is affected by the frequency, voltage, and/or amperage of the electrical current being supplied to the electromagnetic actuator 20. Thus, the thrust can be altered by adjusting either the frequency, the voltage, or the amperage of the electrical current supplied to the electromagnetic actuator 20.

This having been said, by being provided with two separate propulsion generating sub-assemblies 18, the watercraft 10 is steerable by reducing or increasing the thrust being generated by one such sub-assembly relative to the other. Again, this is done by adjusting the amperage, the voltage, and/or the frequency of electrical current being provided to one or both of the electromagnetic actuators 20. Thus, no rudder or other moving part is required to directionally control the watercraft 10.

In view of the above description, it should be appreciated that the invention provides a watercraft propulsion system that has virtually no noise emission and that is highly reliable due to the lack of numerous articulating parts and components.

Figure 5:
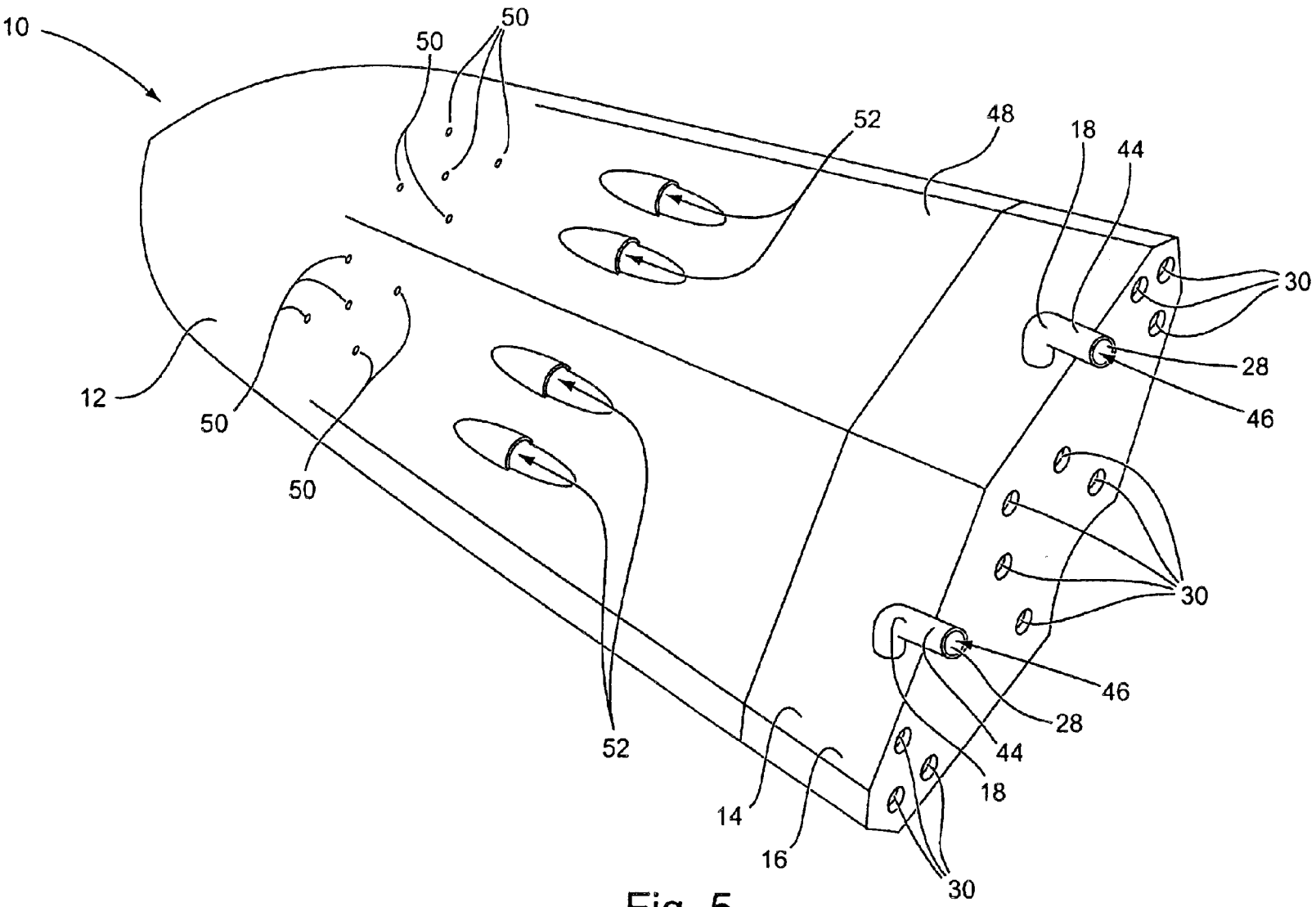
FIG. 5 is perspective view of the watercraft of the preferred embodiment showing the bottom, rear, and side thereof.
Figure 6:
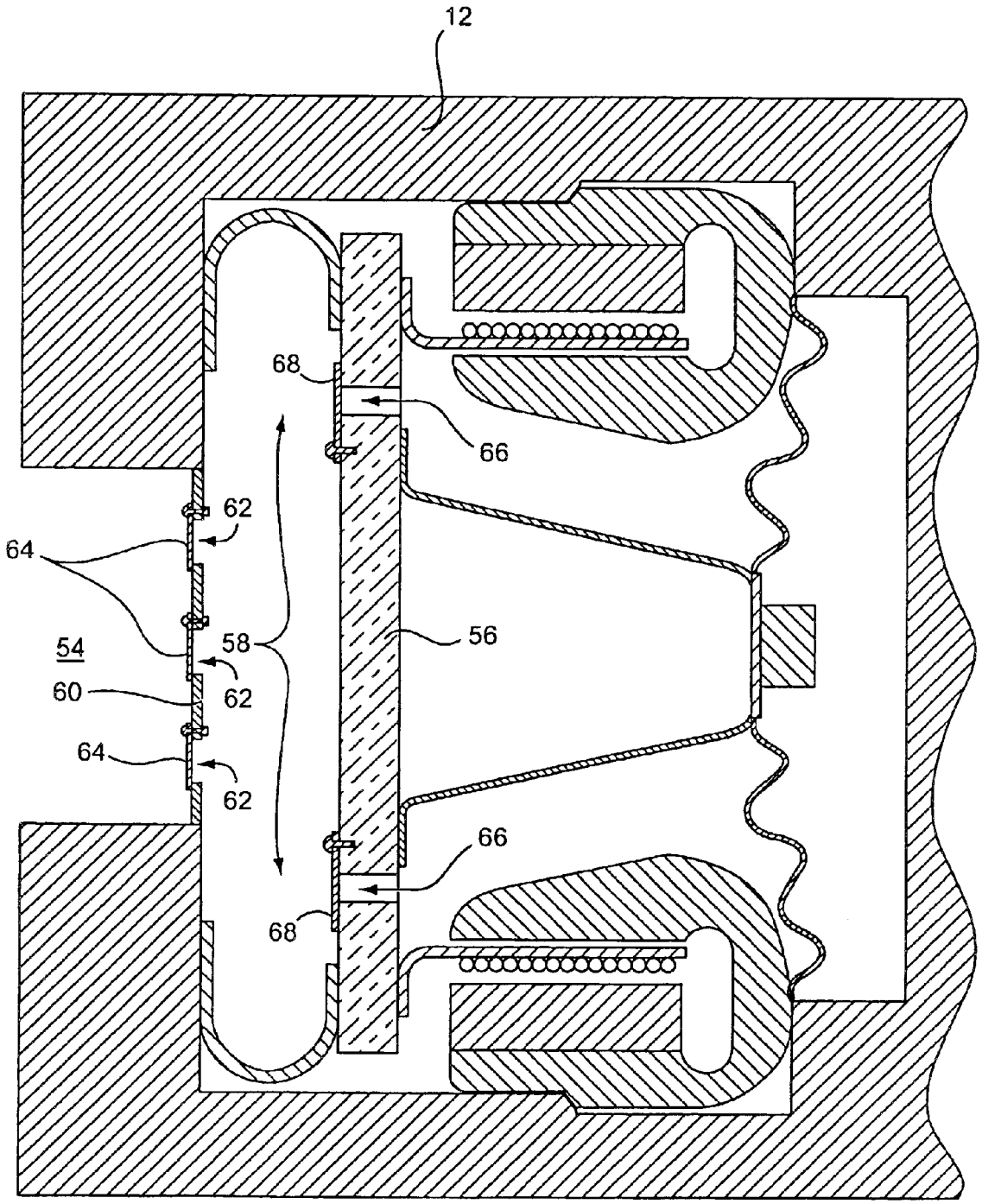
FIG. 6 is a partial cross-sectional view on an optional actuator and valve assembly for pumping gas into the liquid stream boundary layer.

The watercraft 10 also comprises a drag reducing system that operates by actively increasing the momentum of the liquid stream boundary layer adjacent the hull 48 of the main body 12 of the watercraft. The drag reducing system preferably comprises a plurality of fluid ports 50,52 (shown in FIG. 5) that extend through the exterior surface of the hull 48. The drag reducing system may also comprise one or more flow generators (as shown in FIG. 6) that are modified variants of the propulsion generating sub-assemblies 18 described above.

The fluid ports 50,52 are operatively connected to one or more internal fluid passageways of the watercraft 10 and allow for fluid communication between the fluid passageways and the liquid environment that surrounds the hull of the watercraft. The ports 50,52 themselves can vary in configuration. For example, they may be simple openings 50 that are contoured to be flush with the adjacent exterior surface of the hull 48, or, preferably, they may be angle openings 52 configured in manner to expel fluid in direction having an aft component, preferably nearly tangent to the surrounding exterior surface of the hull.

The fluid passageway(s) can optionally be in fluid communication with the liquid chamber 24 of a propulsion generating sub-assembly 18, or one or more similar sub-assemblies that is dedicated to the drag reducing system. If this is done, alternating compression and expansion waves of liquid can be produced at the fluid ports 50,52 in a manner similar to the way such waves are generated at the liquid ports 28 of the propulsion generating sub-assemblies 18.

As an alternative to producing alternating compression and expansion waves of liquid, the fluid ports 50,52 can also be utilized to expel gaseous fluid into the liquid stream boundary layer adjacent the hull 48 of the watercraft 10. To do this, the fluid ports 50,52 are operatively connected to flow generators (such as shown in FIG. 6) that are specifically configured to pump gaseous fluid from a gaseous environment surrounding the watercraft into a fluid passageway 54 and out of the fluid ports 50,52. Like the propulsion generating sub-assemblies 18, such a flow generator preferably comprises a reciprocating member 56 that partial bounds a fluid chamber 58 in manner allowing the volume of the fluid chamber to be increased and decreased. Most other components of the flow generator, such as the actuator, are identical or similar to those of the propulsion generating sub-assemblies 18. However, the flow generator also comprises first and second valves.

The first valve preferably comprises a main member 60 placed between the fluid chamber 58 and the fluid port(s) 50,52. The main member 60 preferably has one or more openings 62 that are configured to allow gaseous fluid to pass therethrough. Flexible membranes 64 are attached to main member 60 in a manner allow the membranes to be deflected away from the openings 62 and in a manner allowing the members to seal against the openings. In this configuration, the first valve functions as an automatic check-valve that operates simply by pressures differentials. In other words, when the volume of the fluid chamber 58 is decreased by the reciprocating member 56, gaseous fluid (preferably air) passes through the openings 62 creating a pressure differential on the membranes 64 that deflects the membranes away from the main member 60 of the valve. When this occurs, the first valve is in an opened position and gaseous fluid within the fluid chamber 58 (which constitutes a portion of the gas passageway 54) communicates with the gaseous fluid in the remainder of the gas passageway to thereby force gaseous fluid from the liquid port(s) 50,52 into the liquid stream boundary layer. Conversely, when the reciprocating member 56 acts to increase the volume of the fluid chamber 58, a pressure differential across the membranes 64 cause the membranes to seal against the main member 60 of the first valve. In this closed position, fluid is prevented from passing into the fluid chamber 58 through the first valve.

Similar to the first valve, the second also preferably acts as an automatic check-valve. Also like the first valve, the second valve preferably comprises one or more openings 66 that are sealable by one or more flexible membranes 68. As shown in FIG. 6, the openings 66 of the second valve may extend through the main body of the reciprocating member 56. The second valve is also movable between opened and closed positions and operates using the same principles as the first valve. However, when the reciprocating member 56 acts to increase the volume of the fluid chamber 58, the second valve moves to its opened position and thereby allows gaseous fluid to be drawn into the fluid chamber 58 through the openings 66 of the second valve. Conversely, decreasing the volume of the fluid chamber 58 causes the second valve to move to its closed position where it prevents gaseous fluid from escaping from the fluid chamber via the opening(s) 66 of the second valve. The openings 66 of the second valve are in communication with a gaseous environment external to the watercraft (preferably through one or more fluid ports positioned above the actual waterline of the watercraft).

It should be appreciated that the first and second valves can be positioned at virtually any location and can be configured in any manner so long as they are in fluid communication with the gas passageway and need not necessarily be near any fluid chamber. Moreover, the first and second valves can be any type of suitable valve and can be actuated between their opened and closed positions via electronic solenoids, commercially available vibration shakers, linear motors, mechanical cams, or other suitable force generating devices (rather than being automatic check-valves).

In view of the foregoing, it should be appreciated that, in operation, the reciprocating action of the reciprocating member 56 causes the flow generator to intermittently force gaseous fluid from the fluid ports 50,52 into the liquid stream boundary layer and to intermittently draw gaseous fluid into the watercraft from the gaseous environment partially surrounding or stored inside the watercraft. The reciprocation of the reciprocating member preferably occurs at a rate of between 20 and 100 Hertz when gaseous fluids are involved.

Regardless of whether a watercraft is configured to expel liquid from the fluid ports or to expel gas from the fluid ports, a reduction in drag is generated. In the case of liquid being expelled from the fluid ports, the expulsion of such liquid adds momentum to the fluid stream boundary layer. This additional momentum at least partially counteracts the reduction of momentum of the fluid stream caused by the surface friction of the hull. In the case where fluid in a gaseous state is expelled from the fluid ports, such gaseous fluid forms a thin layer between the exterior surface of the hull and the adjacent liquid stream boundary layer. Because the coefficient of friction between the fluid stream boundary layer and gaseous fluid is less than the coefficient of friction between the liquid stream boundary layer and the exterior surface of the hull, the overall friction acting on the liquid stream boundary layer is reduced and there is therefore less of a reduction in the momentum of the fluid stream boundary layer. Thus, either way, less momentum losses occur and, as a result, drag is diminished.

While the present invention has been described in reference to specific embodiments, in light of the foregoing, it should be understood that all matter contained in the above description or shown in the accompanying drawings is intended to be interpreted as illustrative and not in a limiting sense and that various modifications and variations of the invention may be constructed without departing from the scope of the invention defined by the following claims. For example, it should be appreciated that, although the watercraft embodiment is disclosed as having fixed nozzles that extend downward and aft, the purpose of this configuration is to ensure that the liquid port remains underwater and to reduce moving parts. However, a pivotal nozzle could also be utilized or the nozzle could be eliminated altogether, such as likely would occur if used on a submersible. Additionally, it should be appreciated that the actuator mechanism need not be a voice coil or even an electromagnetic actuator. To this end, the reciprocating member could be oscillated via a pneumatic, hydraulic, mechanical heat engine, piezoelectric, or other form of actuator. Yet further, multiple liquid ports could be connected to a single liquid chamber. Moreover, the optimum frequency of expansion and compression waves may vary based on the particular configuration of the propulsion assembly, such as the stiffness of the reciprocating member or of the sealing member. Thus, other possible variations and modifications should be appreciated.

Furthermore, it should be understood that when introducing elements of the present invention in the claims or in the above description of the preferred embodiment of the invention, the terms "comprising," "including," and "having" are intended to be open-ended and mean that there may be additional elements other than the listed elements. Similarly, the term "portion" should be construed as meaning some or all of the item or element that it qualifies.

What is claimed is:

1. A method comprising:

providing a watercraft, the watercraft comprising a hull, a fluid chamber, a voice coil actuator, and at least one fluid port, the fluid port allowing fluid communication between the fluid chamber and a liquid environment external to the watercraft;

propelling the watercraft within the liquid environment in a manner such that a liquid stream boundary layer exist adjacent the hull of the watercraft; and repetitively increasing and decreasing the internal volume of the fluid chamber via the voice coil actuator in a manner such that fluid is expelled from the fluid port into the liquid stream boundary layer.

2. A method in accordance with claim 1 wherein the step of repetitively increasing and decreasing the internal volume of the fluid chamber occurs in a manner such that the fluid expelled from the fluid port into the liquid stream boundary layer is in a gaseous state as it is expelled.

3. A method in accordance with claim 2 wherein the step of repetitively increasing and decreasing the internal volume of the fluid chamber occurs in a manner such that the decreasing of the internal volume of the fluid chamber causes the expulsion of fluid from the fluid port into the liquid stream boundary layer and such that the increasing of the internal volume of the fluid chamber causes fluid in a gaseous state to be drawn into the fluid chamber from a gaseous environment external to the watercraft.

4. A method in accordance with claim 1 wherein the step of providing the watercraft occurs in a manner such that the at least one fluid port provides the sole fluid connection between the fluid passageway and the liquid environment.

5. A method comprising:

providing a watercraft, the watercraft comprising a hull, a fluid chamber, first and second fluid ports, and first and second valves, the first fluid port allowing fluid communication between the fluid chamber and a liquid environment external to the watercraft, the second fluid port allowing communication of fluid between the fluid chamber and the gaseous environment external to the watercraft, each of the first and second valves being movable between opened and closed positions, the first valve being configured and adapted to prevent fluid communication between the first fluid port and the fluid chamber when in its closed position and to allow such communication when in its opened position, the second valve being configured and adapted to prevent fluid communication between the second fluid port and the fluid chamber when in its closed position and to allow such communication when in its opened position;

propelling the watercraft within the liquid environment in a manner such that a liquid stream boundary layer exist adjacent the hull of the watercraft; and repetitively increasing and decreasing the internal volume of the fluid chamber in a manner such that the decreasing of the internal volume of the fluid chamber causes the expulsion of fluid in a gaseous state from the first fluid port into the liquid stream boundary layer and such that the increasing of the internal volume of the fluid chamber causes fluid in a gaseous state to be drawn into the fluid chamber from a gaseous environment external to the watercraft, the decreasing of the internal volume of the fluid chamber occurring with the first valve in its opened position and the second valve in its closed position and the increasing of the internal volume of the fluid chamber occurring with the first valve in its closed position and the second valve in its opened position.

6. A method comprising:

providing a watercraft, the watercraft comprising a hull, a fluid chamber, and at least one fluid port, the fluid Port allowing fluid communication between the fluid chamber and a liquid environment external to the watercraft;

propelling the watercraft within the liquid environment in a manner such that a liquid stream boundary layer exist adjacent the hull of the watercraft; and repetitively increasing and decreasing the internal volume of the fluid chamber in a manner such that fluid is expelled from the fluid port into the liquid stream boundary layer and in a manner such that fluid expelled from the fluid port into the liquid stream boundary layer is in a liquid state as it is expelled.

7. A method in accordance with claim 6 wherein the step of repetitively increasing and decreasing the internal volume of the fluid chamber occurs in a manner such that fluid in a liquid state is drawn into the fluid port from the liquid stream boundary layer.

8. A method in accordance with claim 7 wherein the fluid port constitutes a first fluid port and wherein the step of providing the watercraft occurs in a manner such that the watercraft comprises a second fluid port, the second fluid port allowing fluid communication between the fluid chamber and the liquid environment, and wherein the step of repetitively increasing and decreasing the internal volume of the fluid chamber occurs in a manner such that fluid in a liquid state is intermittently expelled from the second fluid port into the liquid environment and such that fluid in a liquid state is intermittently drawn into the second fluid port, the step of propelling the watercraft within the liquid environment occurring via the expulsion of liquid from the second liquid port.

9. A method in accordance with claim 6 wherein the step of repetitively increasing and decreasing the internal volume of the fluid chamber occurs in a manner such that the repetitiveness occurs with a frequency below one-hundred Hertz.

10. A method in accordance with claim 6 wherein the step of providing the watercraft occurs in a manner such that the at least one fluid port provides the sole fluid connection between the fluid passageway and the liquid environment.

11. A method comprising:

providing a watercraft, the watercraft comprising a hull, a voice coil actuator, and a reciprocating member;

providing a liquid environment external to the watercraft, the liquid environment being in liquid communication with the reciprocating member of the watercraft;

propelling the watercraft within the liquid environment in a manner such that a liquid stream boundary layer exist adjacent the hull of the watercraft; and increasing momentum within the liquid stream boundary layer by moving the reciprocating member in a linearly reciprocating manner relative to the hull of the watercraft via the voice coil actuator.

12. A method in accordance with claim 11 wherein the step of increasing momentum within the liquid stream boundary layer occurs via alternating compression and expansion waves created by the moving of the reciprocating member in the linearly reciprocating manner relative to the hull of the watercraft.

13. A method in accordance with claim 12 wherein the step of increasing momentum within the liquid stream boundary layer via alternating compression and expansion waves occurs in a manner such that the alternating compression and expansion waves have a frequency below one-hundred hertz.

14. A method in accordance with claim 11 wherein the watercraft comprises a liquid port, the liquid environment being in liquid communication with the reciprocating member via the liquid port, and wherein the step increasing momentum within the liquid stream boundary layer occurs in a manner such that the moving of the reciprocating member in the linearly reciprocating manner relative to the hull of the watercraft causes liquid to be expelled from the liquid port into the liquid stream boundary layer and to be drawn into the liquid port from the liquid stream boundary layer.

15. A method in accordance with claim 14 wherein the liquid port constitutes a first liquid port and wherein the step of providing the watercraft occurs in a manner such that the watercraft comprises a second liquid port, the second liquid port allowing liquid communication between the reciprocating member of the watercraft and the liquid environment, the step of propelling the watercraft within the liquid environment occurring by liquid being intermittently expelled from the second fluid port into the liquid environment in response to the moving of the reciprocating member in the linearly reciprocating manner, the moving of the reciprocating member in the linearly reciprocating manner also causing liquid to be intermittently drawn into the second fluid port.

16. A method in accordance with claim 14 wherein the step of providing the watercraft occurs in a manner such that the at least one liquid port provides the sole fluid connection between the fluid passageway and the liquid environment.

17. A watercraft comprising:

a hull, the hull having an exterior surface;

a reciprocating member, the reciprocating member being operatively connected to the hull in a manner such that the reciprocating member is linearly movable between first and second positions in a reciprocating manner;

a fluid passageway that is partially bound by the reciprocating member;

a voice coil actuator operatively connected to the reciprocating member in a manner such that the voice coil actuator is capable of moving the reciprocating member from the first position to the second position; and an opening through the exterior surface of the hull, the opening forming a portion of the fluid passageway.

18. A watercraft surrounded by an external environment, the watercraft comprising:

a hull, the hull having an exterior surface;

a reciprocating member, the reciprocating member being operatively connected to the hull in a manner such that the reciprocating member is linearly movable between first and second positions in a reciprocating manner;

a fluid passageway that is partially bound by the reciprocating member; and an opening through the exterior surface of the hull, the opening forming a portion of the fluid passageway, the opening providing the sole fluid connection between the fluid passageway and the external environment.

19. A watercraft in accordance with claim 17 wherein the watercraft is surrounded by an external environment and wherein the watercraft further comprises a valve, the valve being moveable between opened and closed positions, the valve preventing communication between the reciprocating member and the external environment through the opening when the valve is in the closed position, the valve allowing communication between the reciprocating member and the external environment through the opening when the valve is in the opened position.

* * * * *